US007409732B2

(12) United States Patent
Last

(10) Patent No.: US 7,409,732 B2
(45) Date of Patent: Aug. 12, 2008

(54) PROVIDING UNIDIRECTIONAL HINGE, INCREASED BUOYANCY AND PASSIVE TENSIONING FOR BUOYANT-SLAT AUTOMATIC POOL COVER SYSTEMS

(76) Inventor: Harry J. Last, 1010 Koohoo Pl., Kailua, HI (US) 96734

( * ) Notice: Subject to any disclaimer, the term of this patent is extended or adjusted under 35 U.S.C. 154(b) by 447 days.

(21) Appl. No.: 10/980,533

(22) Filed: Nov. 3, 2004

(65) Prior Publication Data

US 2005/0102745 A1 May 19, 2005

Related U.S. Application Data

(60) Provisional application No. 60/517,053, filed on Nov. 4, 2003, provisional application No. 60/517,246, filed on Nov. 4, 2003.

(51) Int. Cl.
*E04H 4/00* (2006.01)

(52) U.S. Cl. ..... 4/502; 4/498; 4/501

(58) Field of Classification Search ..... 4/498–502; 220/216, 218; 160/231.1–231.2, 233
See application file for complete search history.

(56) References Cited

U.S. PATENT DOCUMENTS

| | | | | |
|---|---|---|---|---|
| 3,613,126 | A | 10/1971 | Granderath | |
| 4,411,031 | A | 10/1983 | Stolar | |
| 4,577,352 | A | 3/1986 | Gautheron | |
| 5,732,846 | A | 3/1998 | Helge | |
| 5,761,750 | A * | 6/1998 | Mazzola et al. | 4/500 |
| 5,860,413 | A * | 1/1999 | Bussey et al. | 126/565 |

FOREIGN PATENT DOCUMENTS

| | | |
|---|---|---|
| DE | 19807576 A1 | 10/1998 |
| EP | 0369038 A1 | 11/1988 |
| EP | 0369038 B1 | 11/1988 |

* cited by examiner

*Primary Examiner*—Khoa D Huynh
(74) *Attorney, Agent, or Firm*—David E Newhouse, Esq

(57) ABSTRACT

Invented techniques and associated mechanisms are described for eliminating bi-directional flexure properties of coupled buoyant-slats forming a pool cover while simultaneously increasing the buoyancy of a leading or front portion of the cover and for assuring that the spiraling layers of wound-up layers of a buoyant pool cover are, and remain tightly wound around a submerged, rotatable cover drum at all times.

2 Claims, 4 Drawing Sheets

PROVIDING UNIDIRECTIONAL HINGE, INCREASED BUOYANCY AND PASSIVE TENSIONING FOR BUOYANT-SLAT AUTOMATIC POOL COVER SYSTEMS

RELATED APPLICATIONS

This Application relates to U.S. Provisional Patent Application Ser. Nos. 60/517,053 and 60/517,246 filed Nov. 4, 2003 the entirety of which are incorporated herein by reference and claims any and all benefits to which it is entitled to thereby.

BACKGROUND OF THE INVENTION

1. Field of the Invention

These inventions relate to buoyant-slat automatic pool cover systems and tuning techniques harnessing buoyancy forces for optimizing and overcoming inherent functional deficiencies in such systems.

2. Description of the Prior Art

Automatic pool cover systems utilizing interconnected rigid buoyant slats described in U.S. Pat. No. 3,613,126, R. Granderath, which roll up on a submerged or elevated drum are popular in Europe. Such buoyant slat pool cover systems for non-rectangular shaped pools have covers which emerge from covered troughs below the pool bottom in the center of a pool and extend to the pool ends. [See EPO 0369038 A1 & B1, R. Granderath and DE 19807576 A1, K. Frey.] Descriptions of typical buoyant slats for such pool cover systems are described in U.S. Pat. No. 4,577,352, Gautheron, and in. U.S. Pat. No. 5,732,846, Helge, Hans-Heinz (See also DE 4101727 and EP0 225862 A1.)

U.S. Pat. No. 4,411,031 Stolar describes a pool cover system similar to Granderath where, instead of rigid, hinged buoyant-slats, various floating sheet materials such as a polyethylene poly-bubble, or a laminate of vinyl sheeting and foamed substrate, are floated onto the surface of the pool water. Similar to Granderath, extension of Stolar type covers across pools is reliant on buoyant and gravitational forces.

The disadvantage of buoyant pool cover systems utilizing passive buoyancy or gravity forces for propelling or extending the cover components across a pool surface is that the passive forces are always present, and must be dealt with when the cover is stored fully wound up around the cover drum underneath the pool surface, when the cover unwinds from around the drum on extension, and when the cover winds up around the drum on retraction.

Pool cover systems that use buoyancy to propel floating covers across the pool, most typically wind the cover onto roller drums positioned below the water surface. When the cover is retracted from the pool surface and fully wound up onto the cover drum, the upper extremity or front/leading edge of the cover typically is at least two inches below the water surface of the pool. In some cases, the wound up cover and drum are located in a trough next to the pool. In other cases, the cover and drum may be located in an enclosure near the bottom of the pool, or in a special hidden trough compartment underneath the pool floor aesthetically hiding the cover and roller drum. In all cases, the cover drum mechanism is usually located or covered so that that swimmers and the mechanism cannot interfere with each other.

When a buoyant cover is wound up around the cover drum, underwater buoyancy forces act on both sides of the wound up cover with the cover drum acting as a pivot tending to turn in the direction on the side with the greater force. Accordingly, when the cover is fully retracted, the cover drum must be held stationary. An even more perplexing problem is that buoyancy forces tend to unwind the spirally wound up layers of the cover from around the cover drum, particularly in instances where the tongue or front portion of the cover has less volume (is less buoyant) than the main body cover. Typically, the front end of the cover is not secured when the cover is fully wound up in the retracted storage position. Accordingly, when the outer cover layer on the winding side of the cover drum is more buoyant than the outer cover layer on the extending side of the cover drum, the imbalance of buoyancy between the winding side and extension side with the cover drum held stationary, will pull the front portion of the cover around the wound cover layers in the winding direction, successively until the buoyancy forces on the respective sides (layers) of the cover roll balance (reach an equilibrium). Such passive unwinding or loosening of the retracted cover in the cover drum trough increases the cover roll radius leading to jams when that radius reaches or exceeds a design parameter such as a trough wall. Also such loosening effectively precludes limit switch control over cover extension.

The typical buoyant-slat for a pool cover has a transparent upper or top surface and a dark bottom or undersurface (See U.S. Pat. No. 5,732,846, Helge, col. 1, 11 27-34), The slat is a typically an extruded plastic tube with one or more stoppered, air filled longitudinal flotation chambers, having a longitudinal male, prong hook along one side and a longitudinal female prong-receiving channel along its other side [See FIG. 1]. A plurality of slats are interleaved together to form flexible or rollup-able cover. Buoyant pool cover slats are also quite vulnerable to over heating, i.e., heat increases air pressure in the flotation chambers that can compromise the water tightness of the slat. Water convection cools the dark undersides of the slats forming the cover when the cover is deployed on a pool surface.

The coupling between adjacent coupled slats is essentially a loose, longitudinal, bidirectional hinge that is flexible or bendable back and forth around the longitudinal coupling. The longitudinal prong-channel couplings between adjacent slats are typically configured to allow the longitudinal coupling to flex, with reference to a horizontal floating plane of a pool surface, in an underside direction and in a topside direction. The degree of topside and underside flexibility of the coupling between adjacent buoyant slats cover determines both the direction the cover is wound and the minimum diameter of the cover drum. Typically, the longitudinal couplings of the type shown in FIG. 1 allow a 30° topside flex and a 45° underside flex.

Under most circumstances, buoyancy forces keep the longitudinal couplings between adjacent slats in tension underwater until the couplings reach the pool surface. At the pool surface, tensioning due to buoyancy disappears allowing the coupling to unpredictably flex in opposite (topside-underside) directions. Such bidirectional flexing is a problem as the front or leading edge of the buoyant cover, on extension, emerges up through onto the horizontal surface of the pool unguided [See DE19807576 A1, K. Frey.] In particular, a myriad of different factors, e.g., momentum, wind, surface waves, and the like, all can affect the direction the front edge of the cover flexes. For example, the front edge of the cover emerging adjacent an end/side of the pool or other extending cover component, can flop onto the adjacent deck or other extending cover component, rather than the pool surface. In addition to interrupting automatic extension, if not immediately corrected manually, a flop in the wrong direction can lead to extensive damage. In particular, when the front portion of the emerging cover flexes in the topside direction, the cover folds over onto itself as the buoyancy forces accelerate extension of the remainder of the cover onto the pool surface. Folding the cover over exposes the dark undersides of the buoyant slats to the sun. Warmed by the sun, expanding air confined within the hollow slats can quickly compromise the water tightness of the slats.

SUMMARY OF THE INVENTION

Invented techniques and associated mechanisms are described for eliminating bi-directional flexure properties of coupled buoyant-slats forming a pool cover while simultaneously increasing the buoyancy of a leading or front portion of the cover wherein the longitudinal prong, and female prong-receiving channel couplings between adjacent slats are compressed and held together by a sheet of vinyl material or other suitable flexible material fastened or adhered to the underside surface of the slats under tension. The tensioned sheet material allows flexure or bending of the slats only in the underside direction. Accordingly, as the leading or tongue section of the cover emerges through the water surface, it can only flex or bend toward its underside thus establishing the travel direction of cover on the horizontal pool surface on cover extension.

Other invented techniques taking advantage of passive buoyancy forces, and associated mechanisms described involve placing/floating a buoyancy cylinder in the winding side of an underwater cover drum trough, and stretching strapping fastened to the buoyancy cylinder underneath the cover roll wound up around the cover drum securing it to the opposite wall of trough on the extension side of the cover drum. Pulled by buoyancy forces created by the buoyancy cylinder in the winding side quadrants of the trough, the strapping frictionally engages the cover surface of the pool cover as it winds and unwinds from around the cover drum on retraction and extension assuring that the spiraling layers of wound-up cover are, and remain tightly wound around the cover drum at all times.

DESCRIPTION OF PREFERRED AND EXEMPLARY EMBODIMENTS

Figure 1:
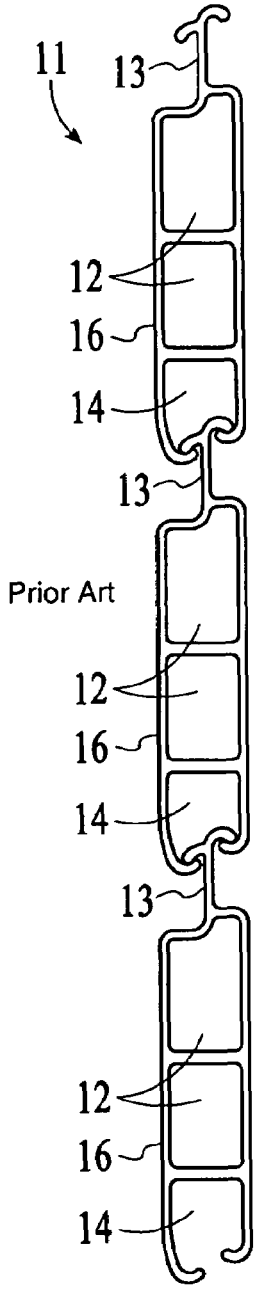
FIG. 1 shows a cross section of typical coupled longitudinal buoyant pool cover slats used by a large segment of the buoyant slat pool cover market.

Looking at FIG. 1, a typical longitudinal, buoyant pool cover slat 11 comprises an extruded plastic tube having one or more longitudinal flotation chambers 12, with a longitudinal prong 13 along one side, and longitudinal female prong-receiving channel 14 along the opposite side. The extruded tubes are cut in lengths appropriate for spanning a pool surface and the ends stoppered (not shown) trapping air within the flotation chambers 12 [See U.S. Pat. No. 5,732,846, Helge]. As pointed out above, the underside 16 of the slats 11 are typically a dark color while the topside is transparent. This allows for solar heating of a covered pool, with water convection cooling the dark under side to prevent over heating compromising water tightness due to trapped air and materials expansion. The longitudinal male prongs of the slats 11 are interleaved into the longitudinal female prong-receiving channel 14 of adjacent slats 11 for forming a flexible cover that can be wound around a cover drum.

Figure 4:
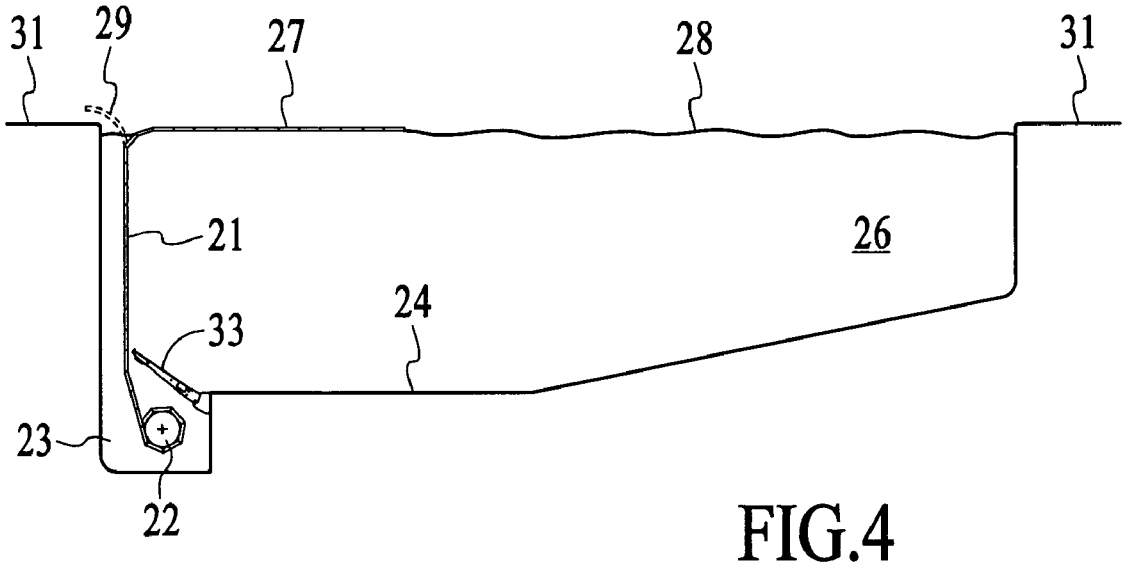
FIG. 4 shows a cross section of a pool with a pool cover trough at one end of the pool from which a buoyant-slat pool cover unwinding from a cover drum is deploying.
Figure 5:
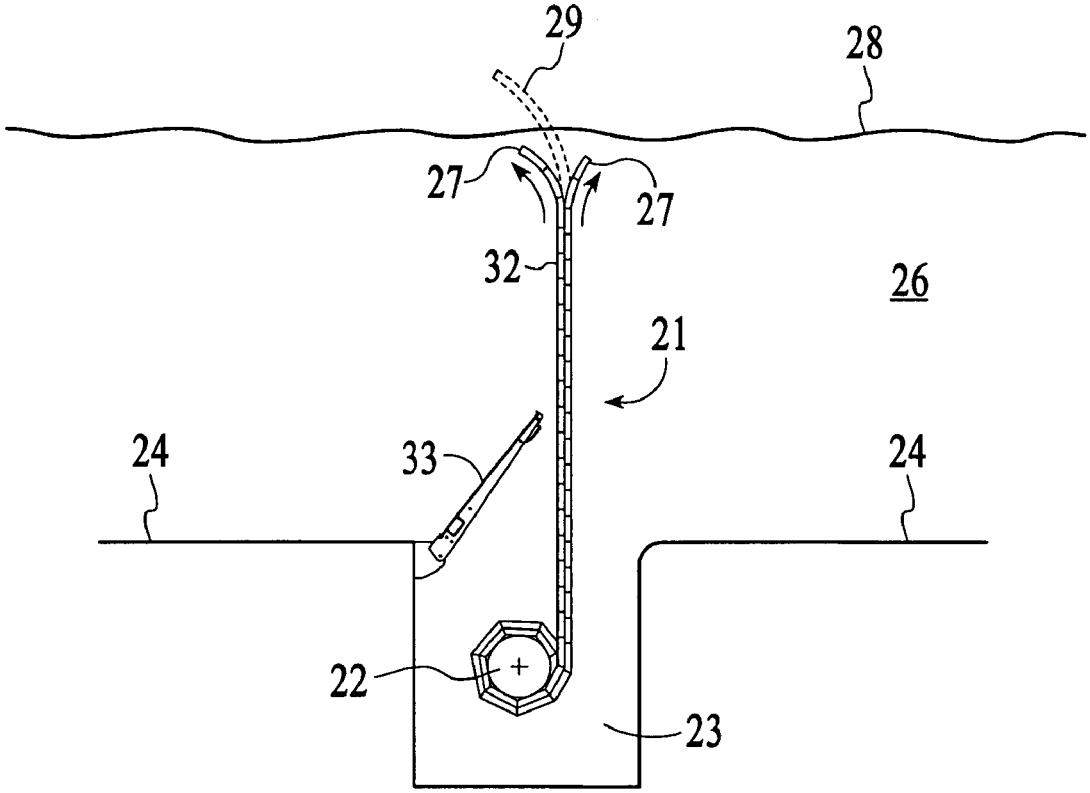
FIG. 5 shows the cross section of a central pool cover trough located beneath below the pool bottom from which dual extending components of a buoyant-slat pool cover are deploying constrained to flex in opposite directions onto the pool surface and float in opposite directions to cover the pool.

With reference to FIGS. 1, 4 and 5 as previously explained, in most circumstances, buoyancy forces acting on coupled buoyant slats 11 forming a pool cover 21 underwater, tension the couplings between adjacent slats 11 such that the prongs 13 of one slat 11 engages the inside shoulders of the female prong-receiving channel 14 of the adjacent slat 11, i.e., the couplings are extended (See FIG. 1) However, when the coupled slats reach the pool surface 28, buoyancy forces cease acting on the couplings and oppositely directed gravity forces take over causing the prongs 13 of slats 11 to transversely slide into the female prong-receiving channels 14 of adjacent slats 11. Momentum of the cover 21 accelerated by buoyancy forces acting on the underwater portion of the cover 21 below the emerging portion likewise will cause the prongs 13 of slats 11 to transversely slide into the female prong-receiving channels 14 of adjacent slats 11 as gravity decelerates the emerging portion of the cover 21 at the pool surface 28.

In short, dynamics at the leading tongue section 27 of a buoyant slat pool cover 21 emerging through a pool surface 28 are not predictable. The couplings between adjacent slats 11 in the emerging tongue section 27 are loosened and gravity acts to redirect momentum of the emerging cover flexing or bending the couplings between adjacent slats 11. If the couplings of the emerging tongue section 27 of the cover 21 flex or bend in the topside direction (illustrated in ghost at 29), the tongue section 27 will be propelled by buoyancy and gravity onto the pool deck 31 (FIG. 4) or onto an adjacent, oppositely extending pool cover element 32 (FIG. 5). The downstream (underwater) remainder of the cover 21 will follow, resulting in a catastrophic failure. However, if the couplings of the emerging tongue section 27 of the cover 21 flex or bend in the underside direction the tongue sections 27 will be propelled by buoyancy and gravity onto the pool surface 28 as illustrated, and the remainder of the cover 21 will follow.

In more detail, the longitudinal junctions or couplings between adjacent slats 11 are not snug, but rather, are loose allowing the prongs 13 to move transversely within the female prong-receiving channels 14. This enables adjacent coupled slats 11 to flex around the longitudinal coupling relative to each other. With reference to a horizontal 'flotation' plane of a buoyant-slat pool cover, the male prongs 13 and female prong-receiving channels 14 of the slats 11, as designed, typically allow for topside flexure above such horizontal reference plane, upward of approximately 30°, and for underside flexure below such horizontal reference plane, downward of approximately 45°.

Figure 2:
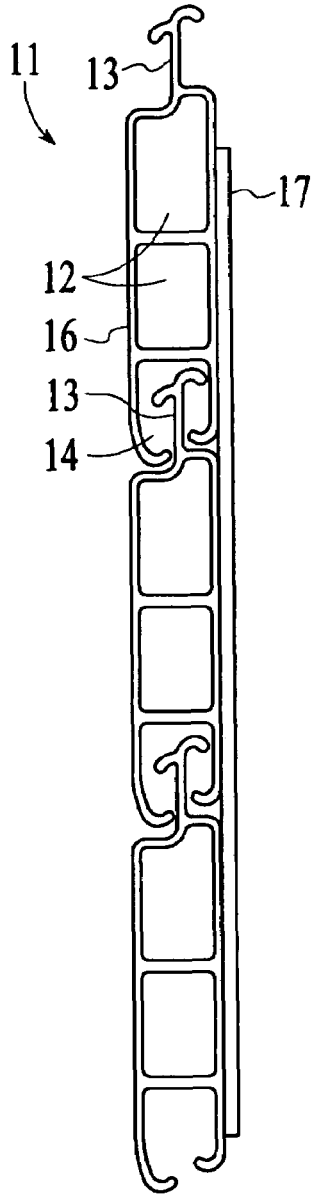
FIG. 2 shows the cross section of the typical coupled buoyant pool cover slats compressed together and constrained by a sheet of vinyl or other suitable flexible material stretched and adhered/fastened to the underside of the slats.
Figure 3:
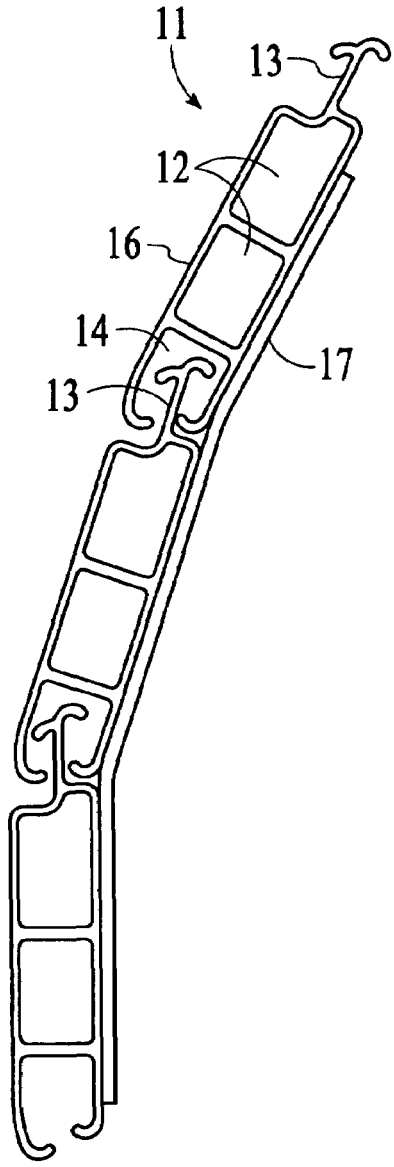
FIG. 3 shows the cross section of the typical coupled buoyant pool cover slats compressed together and constrained by a sheet of vinyl or other suitable flexible material stretched and adhered/fastened to the underside of the slats allowing flexing in a permitted direction only.

Turning now to FIGS. 2 and 3, the invented technique for eliminating bi-directional flexure properties of coupled buoyant pool cover slates is accomplished by compressing adjacent couple slats 11 together and securing them by fastening/adhering sheet of vinyl material 17 or other suitable flexible material to the underside surfaces 16 of the compressed together slats 11. When compressed together, the prong side shoulders 18 of the flotation chamber 12 of each slat 11 resiliently push against the shoulders 19 of the female prong-receiving channel 14 on the adjacent slat 11 tensioning the vinyl material 17 once the bond between the vinyl sheet 17 and the underside 16 of the slats 11 sets. Alternatively, the vinyl material 17 can be stretched or pre-tensioned as it is fastened to the underside 16 of the slats 11 so that once the bond has set, the sheet 17 pulls the adjacent slats together. The vinyl sheet 17 adhered to the underside 16 of the slats 11 effectively tensions or restrains (biases) the underside of the particular section of the buoyant pool cover for resisting bending or flexure of the cover in the topside direction, but allows flexure or bending of the couplings between adjacent slats in the underside direction. (See FIG. 3.)

Figure 8:
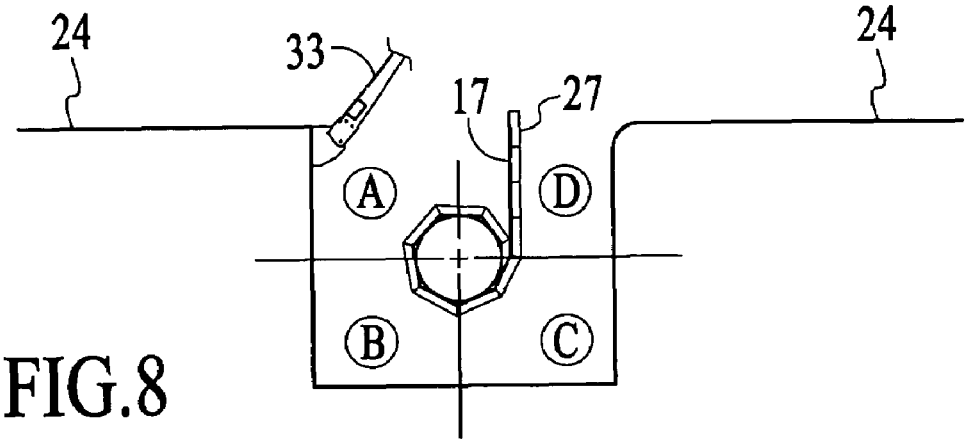
FIG. 8 shows a cross section end view of a buoyant-slat pool cover spirally wound around a cover drum within a pool cover trough below the bottom of a pool divided into quadrants A, B, C and D.

Compressing adjacent buoyant slats 11 together has the added advantage of increasing buoyancy per unit length in the compressed together region of the formed cover over that in uncompressed regions. In particular, looking at FIG. 8, a cross section end view of a buoyant-slat pool cover 21 spirally wound around a cover drum 22 within a pool cover trough 23 below the bottom, surface 24 of a pool 26 is divided into quadrants A B C and D. Quadrants A and B are on the winding side of the trough 23, and quadrants C and D on the extension side. A sheet of vinyl material 17 is fastened to the underside of the front end or tongue section 27 of the cover 21 compressing the buoyant slats of in that section together. Assuming, the slats of the cover 21 are identical, and the cover is rectangular, the cover, in the tongue section 27 will have greater buoyancy per unit length (greater number of slats per meter) than the cover downstream from the tongue section. Greater buoyancy forces acting on the cover on the extension side of the trough 23 (quadrants C and D) than on the winding side of the trough 23 (quadrants A and B), tensions the cover 21 and keeps it tightly wound around the cover drum 22. This means that lengths of cover winding and unwinding for each sequential cover drum revolution on cover retraction and extension cycles, will not significantly vary between different opening and closing cycles. The ability to reliably correlate cover drum rotations to length of cover unwound and/or wound allows for automatic control of both cover extension and retraction using set points and limit switches.

Figure 6:
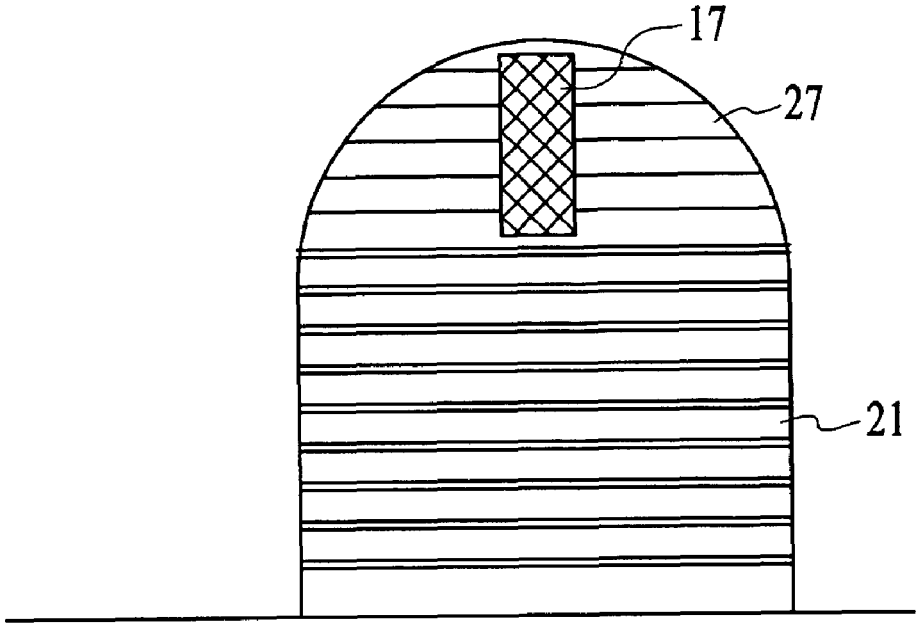
FIG. 6 illustrates a cover shaped to fit a rounded end swimming pool having a rounded tongue section of coupled buoyant pool cover slats constrained, compressed together by a vinyl or other suitable flexible material stretched and fastened to the underside of the slats increasing buoyancy of the tongue section, while assuring the round front end portion of the cover flexes or bends in the downside direction as it emerges onto the pool surface for travel toward the rounded end of the pool.
Figure 7:
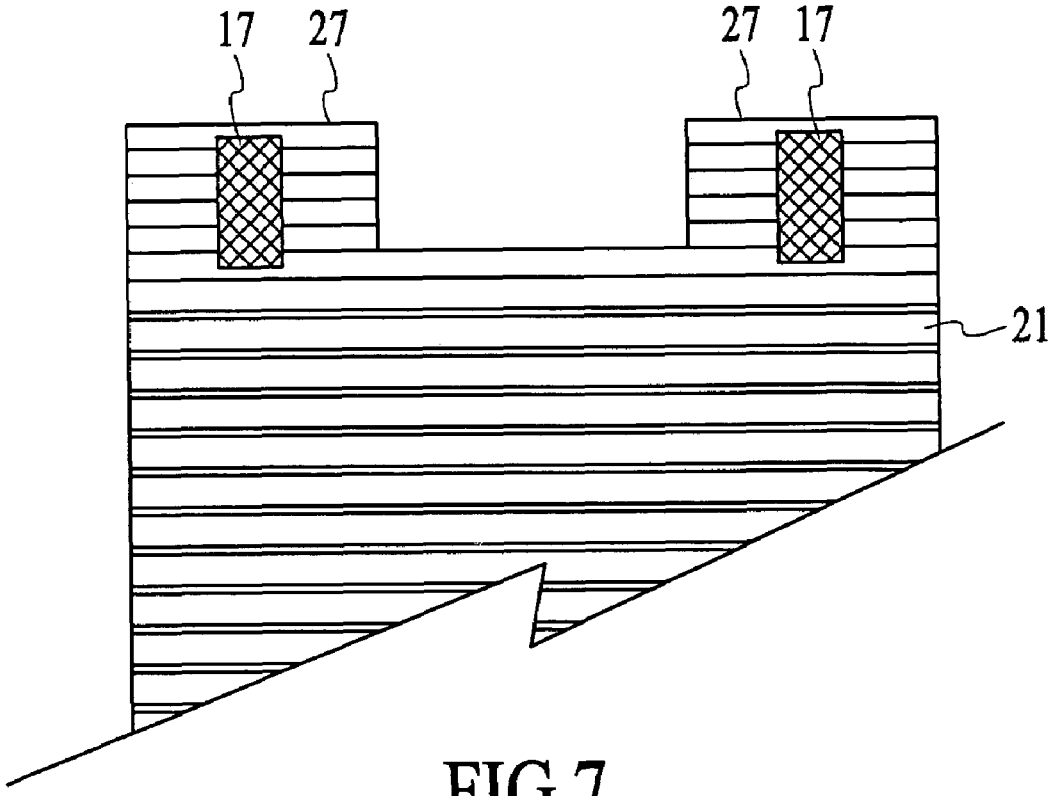
FIG. 7 illustrates yet another shape of pool cover for a pool with a peninsula end having two small leading or front sections where the coupled buoyant pool cover slats are constrained compressed together by a vinyl or other suitable flexible material stretched and fastened to the underside of the slats to assure that the two front sections flex or bend in the proper direction as they emerge onto the pool surface for travel toward the peninsula end of the pool.

However, there are instances where the front end or tongue section 27 of the cover 21, even with the slats compressed together by a vinyl sheet will not provide sufficient buoyancy to overcome that of the outer layer of slats on the winding side (quadrants A & B) of the cover drum trough 23. In these instances the tongue section 27 of the cover 21 is either not as wide as the remainder of the cover as shown in FIG. 6 where the tongue section is semicircular (has a declining width) or does not have the same volume as the remainder of the cover as shown in FIG. 7 where the central portion of the cover tongue 27 is cut out to accommodate a peninsula or other protrusion at the pool end (not shown).

The typical solution of simply letting the smaller volume tongue section 21 extend upward from portion of the cover 21 wound around the cover drum 22 is not feasible particularly when a lid 33 over the cover drum trough is desirable or required for isolating the fully retracted, stored cover 21 from swimmers recreating in the pool.

Figure 9:
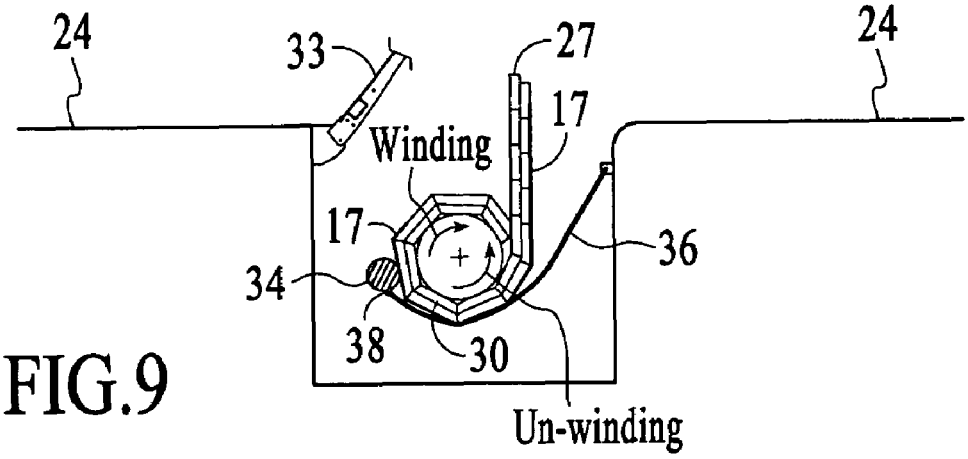
FIG. 9 shows a cross section end view of a buoyant-slat pool cover spirally wound up around a cover drum within a pool cover trough below the bottom surface of a pool with a buoyancy cylinder floating in the winding side quadrants A and B of the trough held by strapping stretched underneath the cover and drum and fastened to the upper edge of the opposite wall of the trough in the extension side quadrants C & D of the trough.
Figure 10:
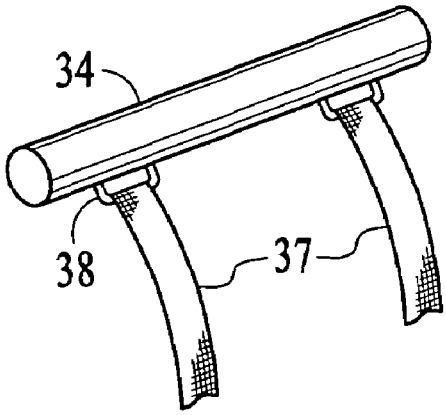
FIG. 10 is a perspective view showing the buoyancy cylinder, strapping bales and suitable strapping fastened to the bales.

The better solution, illustrated in FIGS. 9 and 10, is to locate or float a buoyancy cylinder 34 in the winding side (quadrants A & B) of the cover drum trough 23 secured by a sheet 36 of flexible strapping material (FIGS. 6 & 9) or separated straps 37 (FIGS. 7 & 10) stretched down underneath the cover roll 30 and cover drum 22, then up to near the top of the opposite wall on the extension side (quadrants C & D) of the cover drum trough 23 where it is fastened. The strapping sheet 36 or separated straps 37 pulled by the buoyant force generated by the buoyancy cylinder 34 in quadrants A & B frictionally engage the surface of the cover 21 braking (resisting) its movement as the cover is wound up onto or unwinds from around the cover drum 23. It should be appreciated that the area of friction engagement between the cover drum roll and webbing/straps 36/37, and the buoyant force provided by the buoyancy cylinder 34 moving up and down in the cover drum trough 23 both increases as the radius of the cover roll 30 increases.

Also, it should be appreciated that the surface of the buoyancy cylinder 34 will come into contract with and wear the surface of the cover roll at some point as its radius increases as the cover 21 is wound onto the cover drum 22. Accordingly, as illustrated the webbing/straps 36/37 are preferably secured to bales 38 extending downward from the bottom of the buoyancy cylinder 34 such that the webbing/strapping 36/37 material is not located between the moving surface of the winding/unwinding cover 21 and the stationary surface of the buoyancy cylinder 34. It is also possible to mitigate deleterious effects of contact wear between the surface of the buoyancy cylinder 34 and buoyant slats 11 forming cover 21 again by adhering/securing sheet of vinyl material 17 (whether or not compressing) to the underside surface of the slats 11 forming the cover 21 where the underside surface of the cover is the outside surface of the cover roll 30 (see FIG. 9).

The invented techniques and associated mechanisms for taking advantage and utilizing passive buoyancy forces for assuring and fine tuning automatic operation of buoyant-slat pool cover systems have been described in context of both representative and preferred embodiments which have reference to automatic swimming pool cover systems invented and developed by the Applicant and others. [See Applicant's copending application Ser. No. 09/829,801 filed Apr. 10, 2001 entitled AUTOMATIC POOL COVER SYSTEM USING BUOYANT-SLAT POOL COVERS.] It should be recognized that skilled engineers and designers could specify different configurations for the described mechanisms implementing the invented techniques that perform substantially the same function, in substantially the same way to achieve substantially the same result as those components described and specified in this application. Similarly, the respective elements described for effecting the desired functionality could be configured differently, per constraints imposed by different mechanical systems, yet perform substantially the same function, in substantially the same way to achieve substantially the same result as those components described and specified by the Applicant above. Accordingly, while mechanical components suitable for implementing the invented techniques may not be exactly described herein, they will fall within the spirit and the scope of invention as described and set forth in the appended claims.

I claim:

1. A technique for eliminating bi-directional flexure properties of front ends of floating, longitudinally coupled, buoyant-slat pool covers flexible bi-directionally around axes parallel to the buoyant-slats, and for increasing buoyancy of the front ends of the covers, adapting the covers for deployment from underwater cover drums, comprising the steps of:

a) compressing adjacent, longitudinally coupled, buoyant-slats forming a leading section only at the front end of the cover closer together; and b) adhering a sheet of flexible, water compatible material only to underside surfaces of the compressed together, buoyant-slats forming the leading section at the front end of the cover, the longitudinally coupled, buoyant-slats, compressed closer together, tensioning the adhered sheet of flexible, material when underwater, that in turn tensely resists flexure of those compressed closer together, longitudinally coupled, buoyant-slats of the leading section at the front of the cover in a topside direction while permitting flexure in a downside direction as the front end of the pool cover emerges from underwater through a pool surface, and increases the buoyancy per unit length of the leading section of the cover relative to immediately following sections for unwinding the pool cover from around the underwater cover drum; and c) fastening back ends of the pool covers to the underwater cover drums for deployment, unwinding from around the underwater cover drums, and for retraction, winding up around the underwater cover drums.

2. An improved, underwater deployed, pool cover unwinding from around a cover drum located below a pool surface fastened at the pool cover's back end, the improvement comprising, in combination:

a) a plurality of longitudinally coupled, buoyant-slats forming a floating pool cover flexible bi-directionally around axes parallel to the coupled, buoyant-slats of the cover, fastened to and winding around, and unwinding from around the cover drum located below the pool surface;

b) a sheet of material adhered to underside surfaces of adjacent, longitudinally coupled, buoyant-slats only at a leading, front end section of the pool cover for: (i) holding those buoyant-slats closer together, compressing the longitudinal couplings between those buoyant-slats, (ii) resisting flexure of the leading, front end section of the pool cover as it emerges through the pool surface in an upside direction around axes parallel to the coupled, buoyant-slats, (iii) allowing flexure of the leading, front end section of the pool cover in a downside direction around axes parallel to the coupled, longitudinal buoyant-slats, and (iv) increasing buoyancy of the leading, front end section of the pool cover relative to following sections of the pool cover.

* * * * *